United States Patent [19]

Crisp, Jr.

[11] 4,351,527

[45] Sep. 28, 1982

[54] DOUBLE ACTING EXERCISER

[76] Inventor: Melvin L. Crisp, Jr., No. 4 Bales La., Ponca City, Okla. 74601

[21] Appl. No.: 196,698

[22] Filed: Oct. 14, 1980

[51] Int. Cl.[3] ..... A63B 21/02

[52] U.S. Cl. ..... 272/137; 272/142; 272/138; 272/141

[58] Field of Search ..... 272/141, 142, 143, 137, 272/136, 72, 83 R; 267/70, 71, 72, 166, 167, 8, 136

[56] References Cited

U.S. PATENT DOCUMENTS

| | | | |
|---|---|---|---|
| 818,242 | 4/1906 | Geisel | 272/141 |
| 1,980,861 | 3/1933 | Hunter | 272/83 |
| 2,421,822 | 6/1947 | Wood | 267/70 X |
| 3,343,837 | 12/1964 | Grzybowski | 272/83 |
| 3,428,312 | 2/1969 | Macken | 272/80 |
| 3,498,609 | 3/1970 | Lukins | 272/83 |
| 3,759,514 | 9/1963 | Cox | 272/83 R |
| 3,784,195 | 1/1974 | Johnson | 272/141 |
| 3,815,904 | 6/1974 | Weiss et al. | 272/82 |
| 3,947,025 | 3/1976 | Hobby | 272/83 |
| 3,982,757 | 9/1976 | McDonnell | 272/134 |
| 3,995,853 | 12/1976 | Leluty | 272/132 |
| 4,214,748 | 7/1980 | Blackmon | 272/67 |
| 4,239,212 | 12/1980 | Hickey | 272/142 |

*Primary Examiner*—Richard C. Pinkham
*Assistant Examiner*—William R. Browne

[57] ABSTRACT

A double acting exerciser has a tubular body; a first compressible resilient member disposed within the tubular body and prevented from passing from the first end thereof by a holding member; a rod member having an abutting member on its first end which abuts against the first end of the first resilient member, the second end of the first resilient member abutting against the holding member; the rod member having a second resilient member about it, having a cap member for the second end of the tubular body about it and also affixed to the second end of the body member; the rod member having a handle member affixed at or near its second end; the tubular body having a second handle member affixed at or near its first end. In a presently preferred mode, the tubular body has a base member fixable to its first end. The exerciser is useful to carry out an extraordinary number and kind of body exercising and building exercises.

9 Claims, 3 Drawing Figures

DOUBLE ACTING EXERCISER

BACKGROUND OF THE INVENTION

The invention relates to an exerciser or a device to aid in the exercise or body building of humans.

Brief Description of the Prior Art

The following, inter alia, is intended to be a prior art statement in accordance with the requirements and guidance of 35 CFR 1.5, 1.97, and 1.98.

Adequate exercise is of importance in maintaining health. It is of more importance with a trend to less active life styles. Certain exercises are of physiotherapeutic benefit in treatment. Body building is a continuing source of satisfaction to many.

A variety of devices have been proposed to air in such exercising or body building activities. The following U.S. Pat. Nos. were cited by a searcher who conducted a pre-examination search relating to the invention: 3,343,837; 3,759,514; 1,980,861; 3,815,904; 3,947,025; 3,498,609; 3,995,853; 3,982,757; and 3,428,312. Of this prior art, 3,759,514 and 3,343,837 appear to be the most nearly related to applicants invention. However, both of these disclosures differ substantially from applicant's invention, and are deemed to largely exemplify the state of the art only.

It should be understood that no representations are made as to thoroughness or exhaustiveness of the pre-examination search which was made.

U.S. Pat. No. 3,343,837 discloses a spring-biased exercising device having a tubular body and handles. However it employs tension springs and telescoping body members. It differs in fundamental design and a number of other important aspects from applicant's invention. The result of its use is limited substantially lessor number and kind of exercises than applicant's exerciser. Applicant's exerciser constitutes an unobvious advance in the art over the design.

U.S. Pat. No. 3,759,514 discloses a compression spring biased hand held exerciser. However, as an integral unit it is only suitable for exercise resulting in compressing the handles together. In order to do pulling apart exercises it is necessary to employ the endless rope 12 as disclosed in lines 30–40 of column 2. This is an entirely different concept than is employed in accord with applicant's invention.

OBJECT OF THE INVENTION

An object of the invention is to provide a relatively inexpensive, easily transportable, easily storable, exerciser which is suitable for an extraordinary variety of exercises and body building activities.

SUMMARY OF THE INVENTION

A double acting exerciser of extraordinary versatility comprises:

(a) a tubular body;

(b) a first compressible resilient member disposed within the tubular body and prevented from passing from the first end thereof by the first holding member;

(c) a rod member having an abutting member on its first end which abuts against the first end of the first resilient member within the tubular body;

(d) a second compressible resilient member positioned in the annulus between the rod member and the tubular body;

(e) a second holding member positioned about the rod member and affixed to the second end of the tubular body such as to permit reciprocating motion of the rod member there through and to prevent movement of the second compressible resilient member beyond the second end of the tubular body;

(f) a first handle member affixed at or near the second end of the rod member;

(g) a second handle member affixed at or near the first end of the tubular body.

In one presently preferred mode, the exerciser has a dismountable base member fixable to the first end of the tubular body.

In another presently preferred mode, the first handle member of the exerciser comprises an assembly with two handles suitable for gripping with both hands.

DESCRIPTION OF THE DRAWINGS

Figure 3:
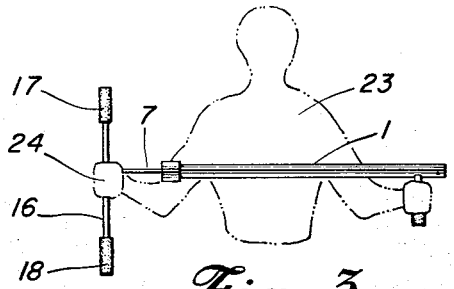
FIG. 3 shows the exerciser in use in one of its many modes of operation.

The same numbers are employed in all figures to refer to the same features.

In the embodiment shown, the exerciser has a tubular body 1 which has a holding member 2, an its first end 3. A first resilient member comprising compression springs 4, 5, and 6 is disposed within the tubular body 1 and prevented from passing from its first end 3 by the holding member 2, a common bolt held in place by a nut.

A rod member 7 has an abutting member 8 on its first end which abuts against the first end 9 of the first resilient member within the tubular body.

A second compressible resilient member comprising compression springs 10, 11, and 12 is positioned in annulus 13 between the rod member 7 and the tubular body 1. The abutting member 8 is held between the first compressible resilient member and the second compressible resilient member within the tubular body 1 by a second holding member 14 which is positioned about the rod member and affixed to the second end of the tubular body by threads mating with threads 15 on the second end 26 of the tubular body 1, such as to permit reciprocating motion of the rod member 7 therethrough.

A first handle member 16 comprising a first hand grip 17 adopted for gripping by hand 24 and a second hand grip 18 on the opposite side is affixed to the second end 19 of rod member 12 by means of mating threads.

A second handle member 20 is affixed near the first end 3 of the tubular body 1 such that movement of the handles either together or apart meets with increasing resistance from the springs comprising the first resilient member and the second resilient member.

A base member 21 having collar 22 mating with first end 3 of tubular member 1 is held in place by holding member 2. The base member 21 is adopted for standing upon by feet 25 in the mode of operation shown in FIG. 1.

With the base dismounted the exerciser is also shown being used by person 23 in FIG. 3.

Preferred Embodiments of the Invention

In accord with the embodiment of the invention shown in the figures, a configuration useful to carry out an extraordinary variety of exercises and body building activities is disclosed.

The tubular body 1 can be fabricated of any convenient material such as steel, aluminum, wood, or plastic. For example 1.25 inch diameter aluminum conduit pipe is quite suitable. It can simply be cut to length threaded on one end, have a receiving hole for the bolt or pin holding member drilled near the other end, and have a second handle member 20 affixed, as by welding, clamping, or the like. Though shown in round cross-section, it can be of any convenient cross-sectional shape such as square, triangular, or oblong. A round cross section is often convenient.

The holding member 2 can be a bolt held in place by a nut, a pin held in place with a snap pin, a capped end, or the like. A bolt or pin suitable for also attaching and dismounting the base 21 is convenient and conservative of materials and cost of fabrication.

The rod member 7 can be ordinary steel rod or can be fabricated of other metals, plastic, wood, or the like. It is presently preferred that its surface be smooth or polished so that it may reciprocate readily though or in association with the second holding member 14.

The rod member can be attached to the first handle member 16 by any suitable means. A threaded hole in the handle member threaded to receive threads on the second end of the rod member is convenient, though other means of affixing such as welding, adhesives, clamping, and the like can be employed. The handle member is preferably adopted for gripping by one or both hands depending upon the type of exercise to be done.

The resilient members are shown as ordinary helical coil compression springs. These are quite suitable, although other resilient members such as elastomeric foam members, other types of compression springs, and the like can also be employed. In one presently preferred embodiment, each resilient member is comprised of a plurality of coil springs selectable from a group of springs of varying stiffness. In this manner the resistance of the exerciser can be varied depending upon the strength of the user, which tends to increase with continuing exercise.

The abutting member 8 can be any projection affixed at or near the first end of the rod member adopted to abut resilient members. A simple flat washer of suitable circumferance suffices quite well with the coil spring resilient members shown. Other designs may be more suitable for other resilient members. The abutting member can be welded, adhered, or otherwise affixed to the first end of the rod member 8.

In the embodiment shown in the figures, a base member is easily mountable and dismountable from the first end of the tubular member. This is readily accomplished by means of a collar matable with the tubular member and holdable in place by a bolt, pin, or other fastener. The tubular member can also be threaded on its first end and threadable into mating threads on the base member. Other means of attachment and detachment will be apparent to those skilled in the art.

Second holding member 14 is conveniently threaded cap which screws down upon mating threads on the second end of the tubular body 1. It can conveniently have a hole in its center through which the rod member can reciprocate. The inner surface of the hole is preferably polished or has an antifriction surface. An antifriction surface is readily provided with a plastic insert of a plastic having a low coefficient of friction, such as polyethylene, prolypropylene, or a polyhalocarbon. Alternatively the holding member can be fabricated of a plastic having a low coefficient of friction. Of course, holding members, such as plugs, affixed within the end of the tubular member or upon it can be employed.

The second holding member should permit ready reciprocating movement of the rod member into and out of the second end of the tubular body against the resistance of first one resilient member and then the other.

One unique feature of the inventive exerciser resides in the fact that both pulling-apart and pushing-together exercises can be performed with the same device. Thereby, and because of the exercisers otherwise unique design, a wide variety of exercisers and body building activities are feasible with the light, easily fabricated, inexpensive, easily storable, easy to-travel-with, and quiet-in-operation exerciser of this application. This is particularly the case with the embodiment shown wherein an easily dismountable base and a "T" handle on the second end of the rod member.

Figure 1:
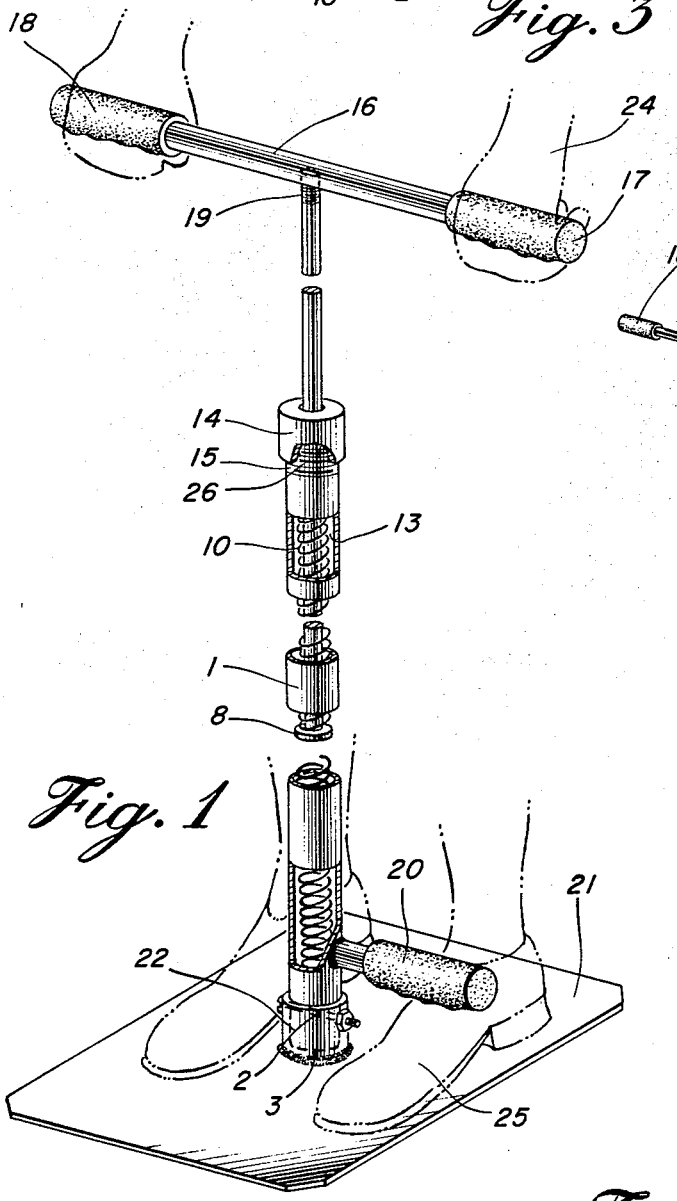
FIG. 1 illustrates a perspective of an embodiment of the exerciser with partial cut-aways for showing of detail.
Figure 2:
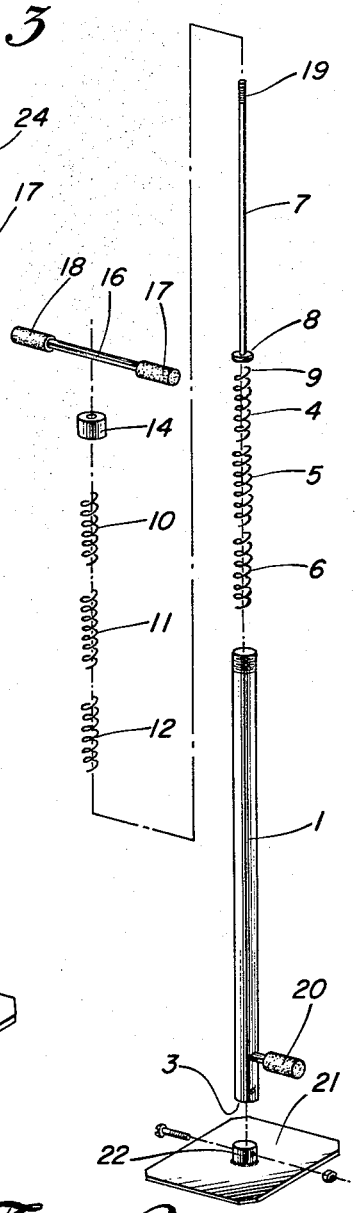
FIG. 2 is a blow-up view, better showing positioning of internal components.

Referring to the embodiment of the invention shown in the Figures, a variety of exercises can be carried out. Some of these exercises are described in the following paragraphs:

In one mode, the person stands on the base with the palms of this hands down and pushes straight down. This particularly exercises the arms, wrists, hands, chest, shoulders, and abdomen. This is shown in FIG. 1.

In another mode, the person stands in the same position, but with the palms up, and pulls up against the resistance of the second resilient means. This exercises and builds the arms, particularly the biceps, chest, and abdomen.

In another mode, the person sits on the base with his back against the tubular body and pulls both hands down against the resistance of the first resilient means. This exercises and builds the arms, neck, shoulder, and back muscles.

In another mode, the person remains sitting as in the previous paragraph, but pushes both hands upward against the resistance of the second resilient means. This exercises and builds the arms, shoulders, neck, side, and back muscles. This is very similar to the "pressing" exercise with weights.

In another mode, the person sits on the base, out faces the tubular member, and pulls down against the resistance of the first resilient means. This exercises the arms, wrists, shoulders, and abdomen, and is very similar to chin-up exercises. This can be done with palms in or out.

In another mode, the person lies on his back with his feet on the base, with the knees flexed on either side of the tubular body, and pulls upward on the "T" handle against the resistance of the second resilient means. Alternatively, the "T" handle is held and the legs are flexed against the resistance of the second resilient means to exercise and build the leg muscles.

In another mode, the person graps the exerciser as shown in FIG. 3, and either pulls the exerciser apart against the resistance of the second resilient means or pushes it together against the resistance of the first resilient means. The chest, arm, neck, and shoulder muscles are particularly exercised and built.

In yet another mode, the person grasps the exerciser as in the next preceeding paragraph, but with the tubular member behind the head. Both in and out exercises are again effected. This particularly exercises the arm, neck, shoulder, and back muscles.

Other ways of employing the exerciser will also suggest themselves to the user.

The tubular body and rod member, as well as other portions of the exerciser, can be sized to the needs of the user. For many persons, a tubular member approximately 28 inches long and a rod member approximately 24 inches long are quite suitable.

Specific exemplification has been presented in this application to better disclose the invention and its presently preferred modes. However, it is to be understood that the invention is not limited by the specific exemplification, but is limited only by the claims in the light of the application as a whole.

I claim:

1. A double acting exerciser suited for exercising of the human body comprising:

(a) a tubular body having a first holding member on its first end;

(b) a first compressible resilient member disposed within the tubular body and prevented from passing from the first end thereof by the first holding member;

(c) a rod member having an abutting member on its first end which abuts against the first end of the first resilient member within the tubular body;

(d) a second compressible resilient member positioned in an annulus between the rod member and the tubular body;

(e) a second holding member positioned about the rod member and affixed to the second end of the tubular body such as to permit reciprocating motion in two directions of the rod member therethrough and to prevent movement of the second compressible resilient member beyond the second end of the tubular body;

(f) a first elongated handle member adapted for gripping by a human hand affixed at or near the second end of the rod member;

(g) a second elongated handle member affixed at or near the first end of the tubular body; such that movement of the handles together and movement of the handles apart both result in a stroke of suitable length and of suitable resistance in both directions for exercising of the human body.

2. The exerciser of claim 1 wherein a base member having a generally flattened surface is fixable to the first end of the tubular body with its axes of flattening generally perpendicular to the long axis of the tubular body, and of suitable dimensions of flattening for positioning of human feet thereon; and wherein the axis of elongation of both the first elongated handle member and the second elongated handle member intersect the long axis of the rod member and the long axis of the tubular body at a substantially right angle.

3. The exerciser of claim 2 wherein the first handle member is suitable for gripping with both hands, with one hand grip on each side of the rod member.

4. The exerciser of claim 1 wherein the tubular body is cylindrical, the first compressible resilient member comprises a coil spring, the second compressible resilient member comprises a coil spring, the second compressible resilient member is positioned about the rod member, the second holding member is a cap for the tubular body having a centered hole through which the rod member passes, the first and second elongated handle members project from the long axis of the tubular member in the same direction, the axis of elongation of the first handle member and the axis of elongation of the second handle member are both at a right angle to the long axis of both the tubular member and the rod member.

5. The exerciser of claim 4 wherein a generally flattened base member suitable for standing upon is fixable to the first end of the tubular body with its axes of flattening generally perpendicular to the long axis of the tubular body, and of suitable dimensions along its axes of flattening for positioning human feet.

6. The exerciser of claim 5 wherein the first and second compressible resilient members comprise a selection of interchangable coil springs of varying stiffness and the cap is readily detachable from the tubular body.

7. The exerciser of claim 6 wherein a plurality of coil springs comprise the first compressible resilient member, a plurality of coil springs comprise the second compressible resilient member, a selection of coil springs of varying stiffness is provided for adjusting the compressibility of the exerciser to match the strength of the user, and the cap has female threads matable with male threads on the second end of the tubular body for easy interchange of the springs.

8. The exerciser of claim 7 wherein the first handle member comprises opposed handles suitable for gripping with both hands when the users feet are planted on the base.

9. The exerciser of claim 4 wherein the first and second compressible resilient member comprise a plurality of interchangable coil springs of varying stiffness and the cap is readily detachable from the tubular body.

* * * * *